US006313403B1

(12) United States Patent
Livingston et al.

(10) Patent No.: US 6,313,403 B1
(45) Date of Patent: Nov. 6, 2001

(54) WIRING DEVICE WITH INTEGRAL AXIALLY ORIENTED GROUND PLATE

(75) Inventors: Thomas Livingston, Homer; John F. Myers, Liverpool, both of NY (US)

(73) Assignee: Pass & Seymour, Inc., Syracuse, NY (US)

( * ) Notice: Subject to any disclaimer, the term of this patent is extended or adjusted under 35 U.S.C. 154(b) by 0 days.

(21) Appl. No.: 09/370,338

(22) Filed: Aug. 6, 1999

(51) Int. Cl.[7] ..... H01H 9/02

(52) U.S. Cl. ..... 174/54; 174/51; 174/53

(58) Field of Search ..... 174/51, 53, 54, 174/59, 60, 61; 200/305, 294, 295, 296, 297; 361/14, 100; 439/95, 97, 108, 939

(56) References Cited

U.S. PATENT DOCUMENTS

| | | | | |
|---|---|---|---|---|
| 2,506,212 | * | 5/1950 | Grohsgal | 174/53 |
| 3,059,045 | * | 10/1962 | Swartwood | 174/53 |
| 3,118,714 | * | 1/1964 | Ludwig | 174/51 |
| 3,148,927 | * | 9/1964 | Winter | 174/53 |
| 3,671,916 | * | 6/1972 | Opalenik | 339/14 R |
| 3,680,031 | * | 7/1972 | Schumacher | 174/51 |
| 3,714,614 | * | 1/1973 | Ludwig | 339/14 R |
| 3,967,049 | * | 6/1976 | Brandt | 174/53 |
| 4,203,638 | * | 5/1980 | Tansi | 174/51 |
| 4,552,421 | * | 11/1985 | Drapkin | 339/14 R |
| 4,793,059 | * | 12/1988 | Moreau et al. | 174/51 |
| 4,836,793 | * | 6/1989 | Munroe | 439/97 |
| 4,865,556 | * | 9/1989 | Campbell et al. | 439/37 |
| 5,798,483 | * | 8/1998 | Nishitani et al. | 174/51 |
| 5,866,844 | * | 2/1999 | Osterbrock et al. | 174/51 |

* cited by examiner

*Primary Examiner*—Dean A. Reichard
*Assistant Examiner*—Angel R. Estrada
(74) *Attorney, Agent, or Firm*—Wall Marjama & Bilinski

(57) ABSTRACT

A wiring device includes a one piece metal strap having end portions adapted to be attached to a junction box, a central opening, and a ground plate integral with the mounting strap having a first portion extending parallel to and adjacent the mounting strap, and a second portion substantially at right angles to the mounting strap.

13 Claims, 5 Drawing Sheets

WIRING DEVICE WITH INTEGRAL AXIALLY ORIENTED GROUND PLATE

BACKGROUND OF THE INVENTION

This invention relates generally to electrical wiring devices and more particularly to a wiring device having a one piece mounting strap and ground plate for reducing the number of parts needed to make the wiring device, and tracing the reliability and convenience thereof.

Electrical wiring devices of the type with which this invention is concerned include a ground plate, usually including a screw or other fastener for attaching a ground wire to the wiring device. Two types of ground plate are commonly used in known wiring devices. A first type of ground plate is integrally formed with a mounting strap portion of the wiring device, that is the plate or strap that is used to mount the device in an electrical junction box.

The mounting plate or strap is typically a stamped metal part, carrying the body of the wiring device in a center portion thereof and having axially extending mounting ears or plates through which mounting screws pass to attach the wiring device to a junction box. In accordance with one known technique for forming a grounding plate, a lateral plate is formed in the mounting plate when it is stamped out, and the plate is bent in a direction transverse to the long (axial) dimension of the mounting plate, and a mounting screw is fitted to the bent plate for attaching a ground lead. This technique is simple, inexpensive, and produces a good electrical connection because the ground plate is integrally formed with the mounting strap. However, this arrangement produces a ground screw that is oriented transversely to the axis of the wiring device, which is undesirable because it makes installation of the wiring device more difficult.

Another known wiring device arranges the ground plate so that the ground screw is oriented along the axis of the wiring device. This is preferred by installers, because installation is simplified, but heretofore all such arrangements have used a ground plate that is a physically separate element from the mounting strap, and which therefore must be physically and electrically attached to the mounting strap to form a low resistance connection that is also mechanically strong.

Providing a separate ground plate and attaching the ground plate to the mounting strap increases the cost of the wiring device, and can decrease the reliability thereof because of the need for making a mechanical and electrical attachment between the ground plate and the strap.

It is an object of this invention to overcome the disadvantages of both known constructions by providing a wiring device having a grounding plate that is integrally formed with the mounting strap and which includes a screw that is oriented along the axis of the wiring device.

It is another object of this invention to reduce the number of parts needed to form a wiring device having a grounding plate and screw oriented as described.

SUMMARY OF THE INVENTION

According to one aspect of this invention, an electrical wiring device comprises a body; a mounting strap attached to the body and having a longitudinal axis, a grounding plate attached to the body and extending at right angles thereto, and an opening for receiving a grounding screw having an axis aligned with the longitudinal axis.

According to another aspect of this invention, a mounting strap for a wiring device having a longitudinal axis comprises a grounding plate at least a portion of which extends perpendicular to the longitudinal axis, and an opening in the grounding plate for receiving a fastener, the opening having an axis oriented parallel to the longitudinal axis, so that the fastener is oriented parallel to the longitudinal axis.

In accordance with a presently preferred aspect of the invention, a wiring device includes a one piece metal strap having end portions adapted to be attached to a junction box, a central opening, and a ground plate integral with the mounting strap having a first portion extending parallel to and adjacent the mounting strap, and a second portion substantially at right angles to the mounting strap.

DETAILED DESCRIPTION OF THE PREFERRED EMBODIMENT

The novel aspects of the invention are set forth with particularity in the appended claims. The invention itself, together with further objects and advantages thereof may be more readily understood by reference to the following detailed description of presently preferred embodiments of the invention taken in conjunction with the accompanying drawings.

Figure 1:
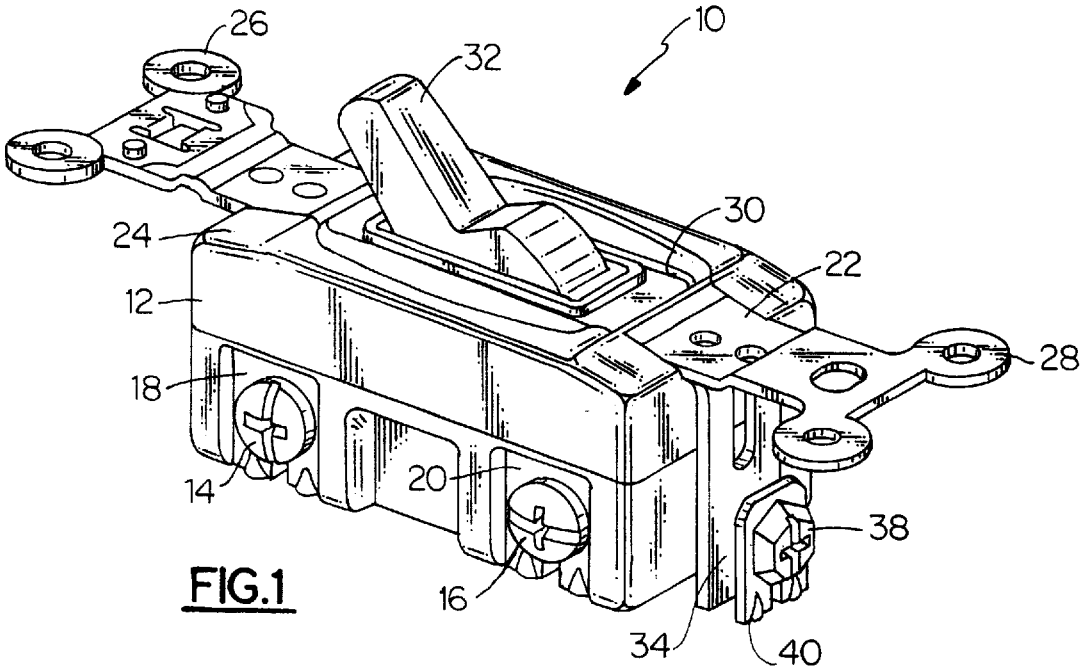
FIG. 1 is a perspective view of a wiring device in accordance with this invention.

Referring now to FIG. 1, a wiring device, more specifically an electrical switch, is illustrated. The switch designated generally at 10 includes a switch body 12 having first 14 and second 16 screw terminals adapted to be connected in an electrical circuit controlled by the switch 10. The screw terminals 14, 16 are adapted to capture and retain the conductive portion of an electrical wire to metal plates 18, 20 under the head of the screw for connecting to a switch mechanism within the switch body 12.

A mounting strap 22 is attached to an upper surface 24 of the switch body 12, and has first and second mounting ears 26, 28 at the ends of the mounting strap 22 extending away from the switch body 12 for mounting the switch 10 within an electrical junction box or the like. The mounting strap has a central opening 30 (see also FIGS. 2–4) through which a switch lever 32 extends. The switch lever 32 controls the switch mechanism within the body 12 for turning the switch 10 on and off, as the lever 32 is manipulated by a user. The mounting strap 22 also includes a ground plate 34 formed integrally with the mounting strap, and extending generally at right angles therefrom. The ground plate 34 is preferably provided with an opening 36 (see FIG. 2) in which a screw 38 is threaded. Preferably, a pressure plate 40 is disposed on the shaft of the screw between the head and the ground plate 34 for capturing a ground wire and forcing it into firm electrical connection with the ground plate 34. The screw 38 is oriented with its access aligned with a major axis of the body of the switch 10, and also with the longitudinal axis of the mounting strap 22. This arrangement is much desired by electrical installers.

Figure 2:
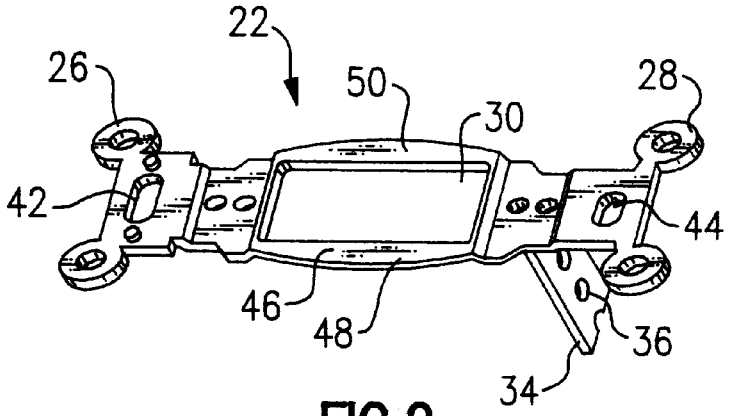
FIG. 2 is a perspective view of a mounting strap having an integral ground plate in accordance with this invention.
Figure 3:
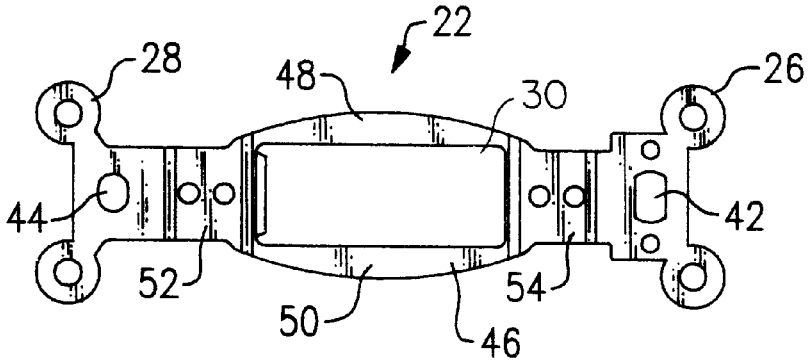
FIG. 3 is a top plan view of the mounting strap of FIG. 2.

The construction of the mounting strap 22 is shown in more detail in FIGS. 2 to 5. Referring now to FIGS. 2 and 3, the mounting strap 22 includes first and second mounting ears 26, 28 at opposed ends thereof, the mounting ears including a plurality of openings 42, 44 for receiving screws or other attachments for attaching the mounting strap to a junction box or the like. The general shape of the mounting ears 26, 28 is conventional and per se well known to those skilled in the art. The mounting strap 22 includes a central body portion 46 having an central opening 30 for receiving the switch operating lever 32 of the switch 10 of FIG. 1. First and second longitudinally extending side portions 48, 50 connect the mounting ears 26, 28 and define the central opening 30 in the center of the mounting strap.

Ground plate 34 extends at right angles to the mounting strap downwardly from the face of mounting ear 28 and includes a preferably threaded opening 36 for receiving a screw 38 for attaching a ground wire to the ground plate 34. The mounting strap 22 including the mounting ears 26, 28 and the ground plate 34 are all integrally formed from a single piece of material, such as stamped metal. The strap 22 is preferably cut from sheet stock, preferably formed on rolls, in a progressive die and forming machine.

Figure 4:
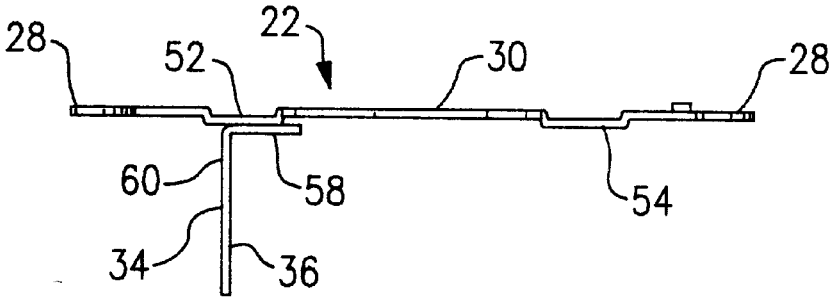
FIG. 4 is a side elevation of the mounting strap of FIG. 2.
Figure 5:
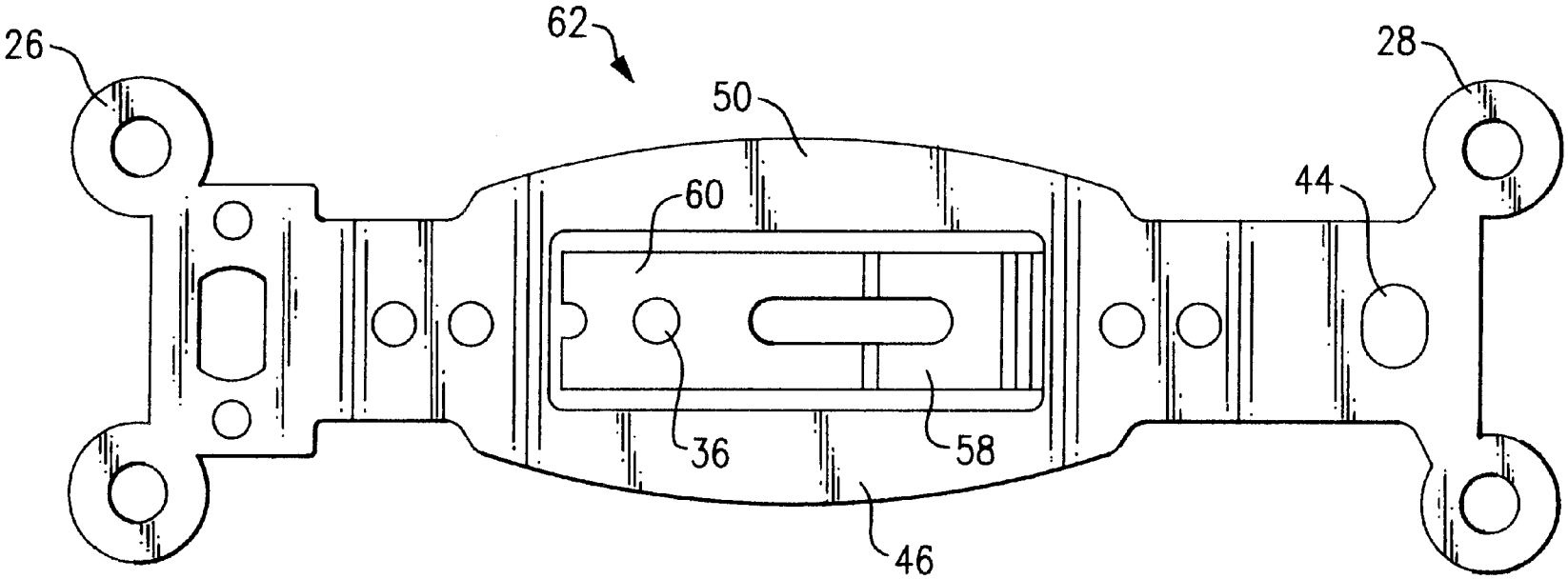
FIG. 5 is a top plan view of a stamped metal plate which is the precursor of the mounting strap of FIG. 2.

Referring now to FIG. 4, it can be seen that the mounting plate 22 is generally flat with first and second depressed areas 52, 54 located between the mounting ears 26, 28 and the central body portion 46 of the mounting strap 22. The ground plate 34 has a first portion 58 extending parallel to the mounting strap 22, and a second portion 60 extending at right angles thereto. Preferably, the ground plate 34 is formed from material cut from the central opening 30 of the mounting strap 22 and folded into the form shown in FIGS. 2 and 4. This permits the ground plate 34 to be made from the same piece of material as the mounting strap, thereby assuring that there is at all times a low resistance electrical connection between the ground plate 34 and the mounting strap 22. FIG. 5 shows a generally flat single piece of stamped metal 62 which is the precursor of mounting plate 22 prior to ground plate 34 being shaped into its working configuration.

Preferably, a screw is received in a threaded hole of the ground plate and arranged with its axis generally parallel to the longitudinal axis of the mounting strap, as shown in FIG. 1.

Figure 6:
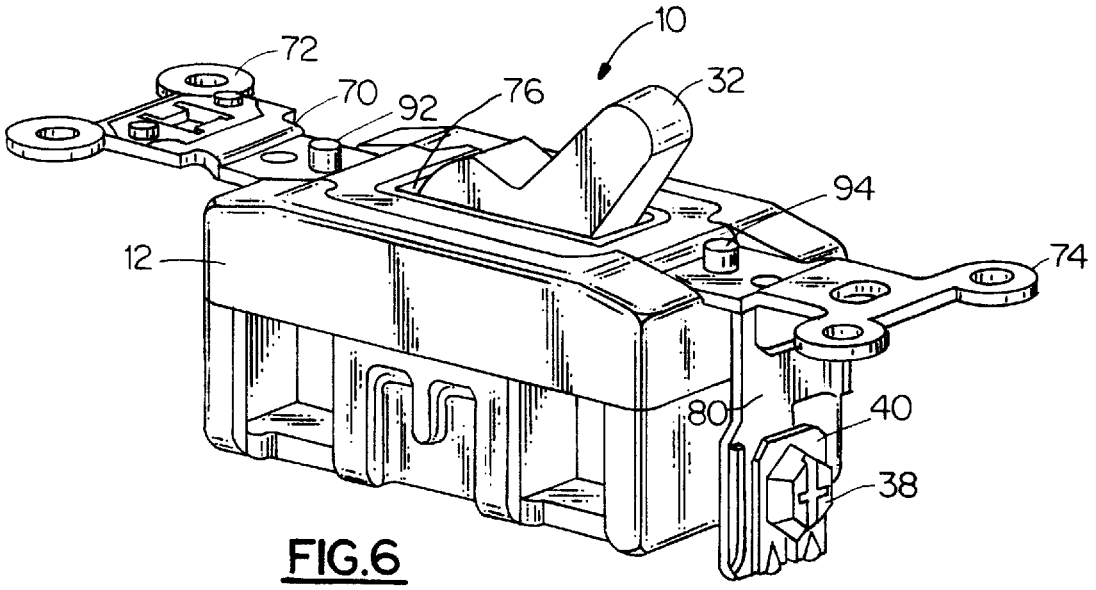
FIG. 6 is a perspective view of a wiring device in accordance with this second embodiment.

An electrical switch 10 having a mounting strap with integral ground plate in accordance with another embodiment of the invention is shown in FIG. 6. A mounting strap 70 is attached to an upper surface of switch body 12 and has first and second mounting ears 72 and 74 extending outwardly from the respective ends of the switch body 12 for mounting the switch within an electrical junction box or the like.

Figure 7:
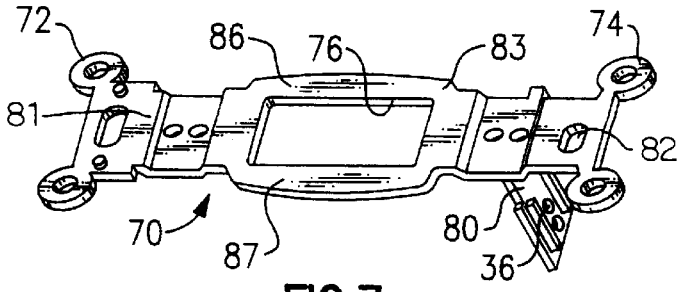
FIG. 7 is a perspective view of a mounting strap having an integral ground plate in accordance with a second embodiment of this invention.
Figure 8:
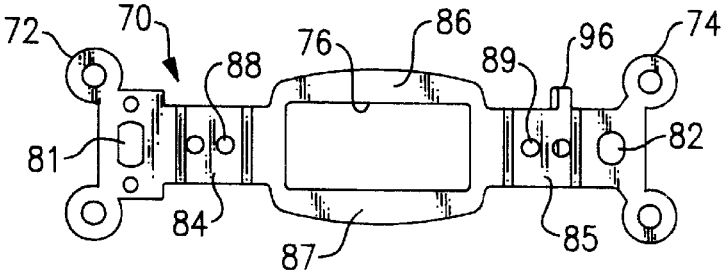
FIG. 8 is a top plan view of the mounting strap of FIG. 7.

Referring also to FIGS. 7–8, the mounting strap has a central opening 76, through which the switch lever 32 extends. The switch lever 32 controls a switch mechanism within the body 12 for turning the switch on and off, as switch lever 32 is manipulated by a user. The mounting strap 70 also includes a ground plate 80 formed integrally with the mounting strap, and extending generally at right angles therefrom. The ground plate 80 is preferably provided with an opening 36 (FIG. 4) for receiving a screw 38, preferably in threaded engagement therewith. Preferably, a pressure plate 40 is captured by the head of the screw between the screw head and the ground plate 80 for capturing a ground wire and forcing it into firm electrical connection with the ground plate 80. The screw 38 is oriented with its axis aligned with a major axis of the body of switch 10 and also with a longitudinal axis of the mounting strap 70.

The construction of the mounting strap 70 may be seen in more detail in FIGS. 7 to 10. Referring first to FIGS. 7–8, the mounting strap 70 includes first and second mounting ears 72 and 74 at opposed ends of the mounting strap, the mounting ears including a plurality of openings 81 and 82, for example, for receiving screws or other attachments for attaching the mounting strap to a junction box with a light. The general shape of the mounting ears 72 and 74 is conventional and per se is well known to those skilled in the art.

The mounting strap 70 also includes a central body portion 83 having an enlarged opening 76 for receiving the switch operating lever 32 as shown in FIG. 6. First and second longitudinally extending side portions 86 and 87 connect the mounting ears 72 and 74, and define the rectangular center opening 76 in the mounting strap.

Ground plate 80 extends at right angles to the mounting strap 70 generally downwardly from the face of the mounting ear 74 and includes a preferably threaded opening 36 for receiving screw 38 (see FIG. 10) for attaching a ground wire to the ground plate 80. The ground strap 80, the mounting ears 72 and 74, and the remainder of the mounting strap 70 are preferably all formed from a single piece of material, such as stamped metal. The mounting strap 70 and ground plate 80 are preferably cut from sheet stock, preferably formed on rolls in a progressive die and forming machine.

Figure 9:
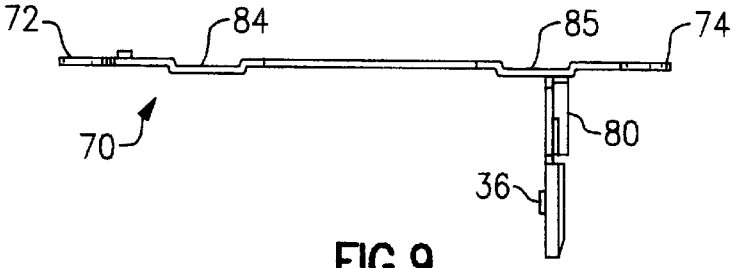
FIG. 9 is a side elevation of the mounting strap of FIG. 7.
Figure 10:
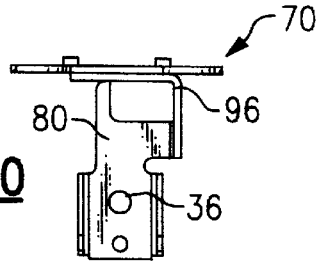
FIG. 10 is an end elevation of the mounting strap of FIG. 7.
Figure 11:
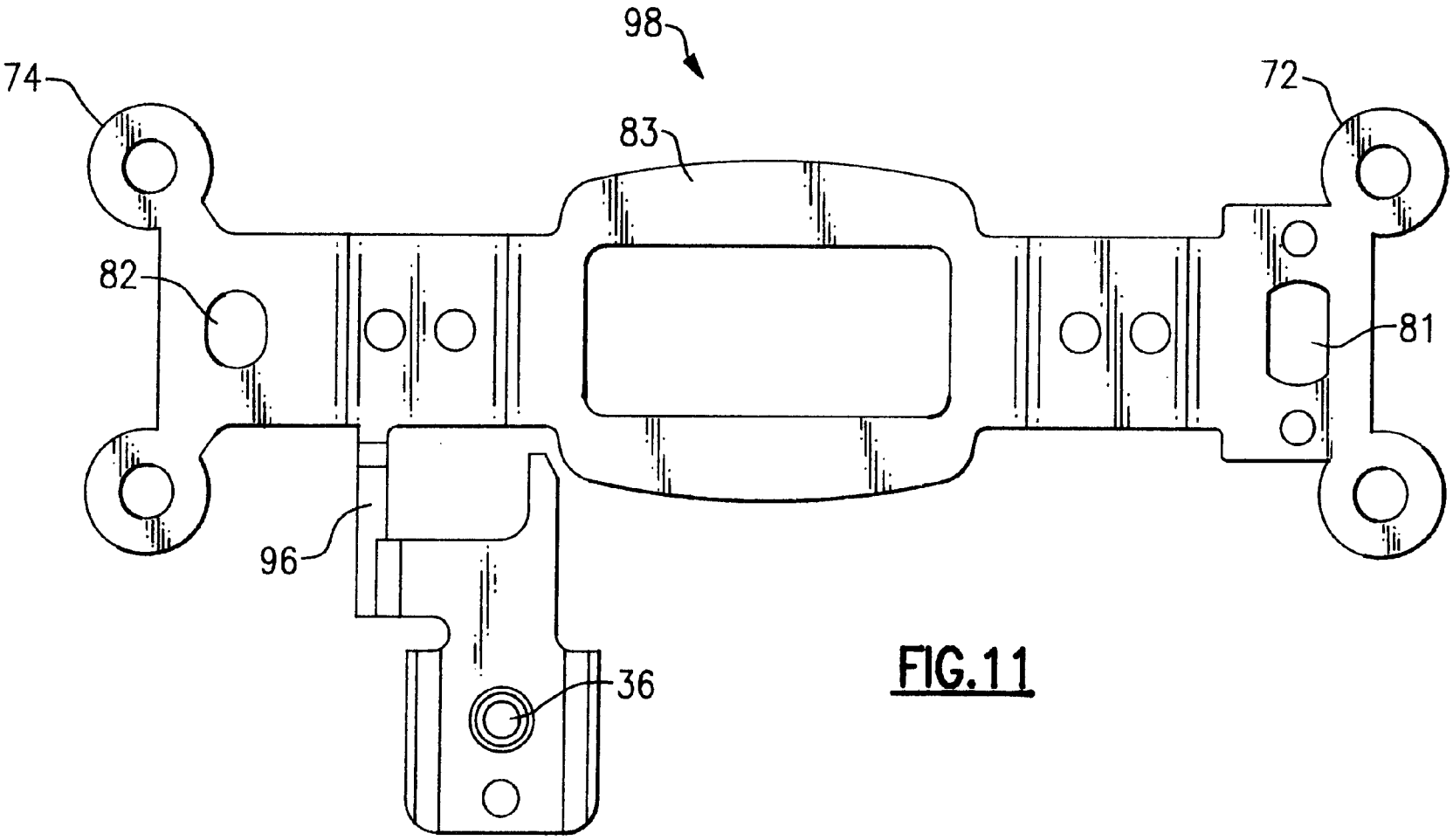
FIG. 11 is a top plan view of a stamped metal plate which is the precursor of the mounting strap of FIG. 7.

Referring now to FIGS. 7 to 10, it can be seen that the mounting strap 70 is generally flat with first and second depressed areas 84 and 85, aligned with flat receiving surfaces on the switch body 12, and including openings 88 and 89 for which rivets 92 or 94 (FIG. 6) or other suitable fasteners may pass to attach the mounting strap to the switch body. A relatively thin attaching neck 96 connects the grounding plate 80 to the strap 70. Preferably the grounding plate 80 is formed along with mounting strap 70 in a single cutting operation and subsequently folded as shown in FIGS. 8 to 10 to a position such that screw 38 has its axis aligned with the longitudinal axis of the mounting strap. Forming ground plate 80 and mounting strap 70 from a single piece of material eliminates the need for a separate mechanical and electrical connection between the ground plate and the mounting strap, thus both improving the electrical characteristics of the combination and simplifying the manufacture thereof. FIG. 11 shows a generally flat single piece of stamped metal 98 which is the precursor of mounting strap 70 prior to ground plate 80 (FIG. 6) being shaped into its working configuration.

While the invention has been described with reference to preferred embodiments, it will be understood by those skilled in the art that various changes may be made and equivalents may be substituted for elements thereof without departing from the scope of the invention. In addition, many modifications may be made to adapt a particular situation of material to the teachings of the invention without departing from the scope of the invention. Therefore, it is intended that the invention not be limited to the particular embodiments disclosed as the best mode contemplated for carrying out this invention, but that the invention will include all embodiments falling within the scope and spirit of the appended claims.

What is claimed:

1. An electrical wiring device, comprising:

a body;

a mounting strap attached to the body and having a longitudinal axis;

a grounding plate attached to the body and extending at right angles thereto; and an opening for receiving a grounding screw having an axis aligned with the longitudinal axis of the mounting strap;

in which the grounding plate is integral with the mounting strap.

2. The wiring device of claim 1 in which the grounding plate includes a first portion extending parallel to the mounting strap.

3. The wiring device of claim 1 in which the mounting strap and the grounding plate comprise a single piece of material.

4. An electrical wiring device, comprising:

a body;

a mounting strap attached to the body and having a longitudinal axis;

a grounding plate attached to the body and extending at right angles thereto, the grounding plate being integral with the mounting strap; and an opening for receiving a grounding screw having an axis aligned with the longitudinal axis of the mounting strap;

in which the mounting strap includes an opening, and the grounding plate is formed from a material removed from the opening.

5. An electrical wiring device, comprising:

a body;

a mounting strap attached to the body and having a longitudinal axis;

a grounding plate attached to the body and extending at right angles thereto, the grounding plate and the mounting strap comprising a single piece of material; and an opening for receiving a grounding screw having an axis aligned with the longitudinal axis of the mounting strap;

in which the mounting strap and the grounding plate comprise a stamped and formed metal plate.

6. The wiring device of claim 5 in which the grounding plate includes a first portion extending parallel to the mounting strap.

7. A mounting strap for a wiring device wherein the mounting strap has a longitudinal axis, comprising:

a grounding plate at least a portion of which extends perpendicular to the longitudinal axis; and an opening in the grounding plate for receiving a fastener, the opening having an axis oriented parallel to the longitudinal axis, so that the fastener is oriented parallel to the longitudinal axis;

in which the grounding plate is integral with the mounting strap.

8. The mounting strap of claim 7 in which the mounting strap includes an opening, and the grounding plate is formed from material removed from the opening.

9. The mounting strap of claim 7 in which the grounding plate includes a first portion extending parallel to the mounting strap.

10. The mounting strap of claim 7 in which the mounting strap and the grounding plate comprise a stamped and formed metal plate.

11. A method of forming an integral mounting strap and grounding plate for a wiring device comprising:

forming the mounting strap from a piece of metal;

forming a three sided slot in the mounting strap to form a tongue; and folding the tongue so that a part thereof forms a grounding plate extending perpendicular to the mounting strap.

12. The method of forming an integral mounting strap and grounding plate for a wiring device as set forth in claim 11 comprising the additional step, before the step of folding tongue so that a part there of forms a grounding plate extending perpendicular to the mounting strap, of folding the tongue through about 180 degrees so that it lies approximately parallel to the mounting strap.

13. The method of forming an integral mounting strap and grounding plate for a wiring device as set forth in claim 11 comprising the additional step, after the step of folding tongue so that a part there of forms a grounding plate extending perpendicular to the mounting strap, of folding the tongue through about 180 degrees so that it lies approximately parallel to the mounting strap.

* * * * *